United States Patent [19]

Pedersen

[11] 3,948,000

[45] Apr. 6, 1976

[54] HYDRAULIC DOOR OPENERS

[75] Inventor: Pauli Dennis Pedersen, Landskrona, Sweden

[73] Assignee: Ingenjorsfirman Besam Aktiebolag, Landskrona, Sweden

[22] Filed: July 25, 1974

[21] Appl. No.: 491,839

[52] U.S. Cl. ..... 49/340; 60/477

[51] Int. Cl.[2] ..... E05F 15/04

[58] Field of Search ..... 49/264, 273, 274, 334, 49/340, 137; 60/477; 92/130, 132; 185/39, 40

[56] References Cited

UNITED STATES PATENTS 2,552,624 5/1951 Enzenbacher ..... 49/340 X 2,911,210 11/1959 Ferguson ..... 49/334 X

*Primary Examiner*—Kenneth Downey

*Attorney, Agent, or Firm*—Eric Y. Munson

[57] ABSTRACT

A hydraulic door opener comprising a closed hydraulic circuit including a motor for actuating a door operating spring surrounded by a housing which forms a component part of the hydraulic circuit and serves as a reservoir for the hydraulic liquid.

9 Claims, 6 Drawing Figures

HYDRAULIC DOOR OPENERS

BACKGROUND OF THE INVENTION

This invention relates to hydraulic door openers for manipulating swing doors or sliding doors or gates or other means for controlling traffic by vehicles or people through a passage way.

In many buildings and other structures it is often desirable to control passage ways for people or vehicles by doors or gates or other means which are manipulated by devices which for simplicity in this specification are generically called "hydraulic door openers". The space available for these devices is often restricted due to the door structure and since it is often desirable from architectural and other view points that the devices are neat and not cumbersome and can be placed more or less concealed in the structure. It is also important that the devices are reliable in function over a long time and easy to service when repair may be necessary.

A well-known device of the above type consists of an electric motor driven hydraulic pump which operates a hydraulic motor which in turn operates the door or gate in one direction of movement and tensions a spring whereas the spring operates the door or gate in opposite direction of movement, but said device is complicated and cumbersome and can easily get out of order. Other devices comprise linear hydraulic motors which make them still more cumbersome and often involves undesirable toothed rack structures.

SUMMARY

The invention solves the above and other problems and provides a device which is built up in a simple way by simple and reliable components which makes the device very flexible in application to door or gate structures of varying types. The device may be used so that the door or gate may be opened hydraulically and closed by the spring or vice versa. For these and other purposes the invention provides a hydraulic door opener comprising in combination a hydraulically operated rotary motor, a motor shaft mounted in the motor and operatively connected with door engaging means, a hydraulic liquid reservoir, a door operating spring operatively connected with the shaft, a motor-driven hydraulic pump, an actuator for the motor of the motor-driven pump, and hydraulic liquid conduits providing communication between the hydraulic pump, the hydraulically operated rotary motor and the hydraulic liquid reservoir and from the reservoir back to the pump so as to produce a closed hydraulic circuit, the rotary motor operating a door to tension the door operating spring, the hydraulic door opener being characterized by the provision of a spring housing for the door operating spring surrounding the spring and providing hydraulic liquid reservoir means forming part of said hydraulic liquid circuit.

One embodiment of such a hydraulic door opener comprises in combination a frame, a transmission casing in which is mounted the rotary motor shaft and a spring shaft to which the door operating spring is fixed, and power transmitting means operable to transmit power between the spring and the rotary motor shaft, the rotary motor and the spring housing being mounted on the transmission casing which is mounted on the frame together with the door engaging means, the transmission casing and the spring housing together forming the said hydraulic liquid reservoir.

In another embodiment of such a hydraulic door opener, a door engaging or carrying main shaft is mounted to turn on bearings in a bearing housing secured to the frame and a lever system is arranged to transmit turning motion from the spring shaft or the rotary motor shaft to the main shaft in one turning direction upon actuation of the rotary motor and in the opposite turning direction by the spring when the rotary motor is unactuated.

The door openers according to the invention may be provided with means for producing slow motion at the end or ends of the door movement as is well-known in the art, and also with means for producing an adjustable time delay in the operation of the pump motor which may involve the use of time delay relays in an electric motor actuating circuit or dash pot means in a pneumatic pump motor circuit.

BRIEF DESCRIPTION OF THE DRAWINGS

The invention will be described further, by way of example only, with reference to the accompanying drawings, in which.

DESCRIPTION OF THE PREFERRED EMBODIMENTS

Figure 1:
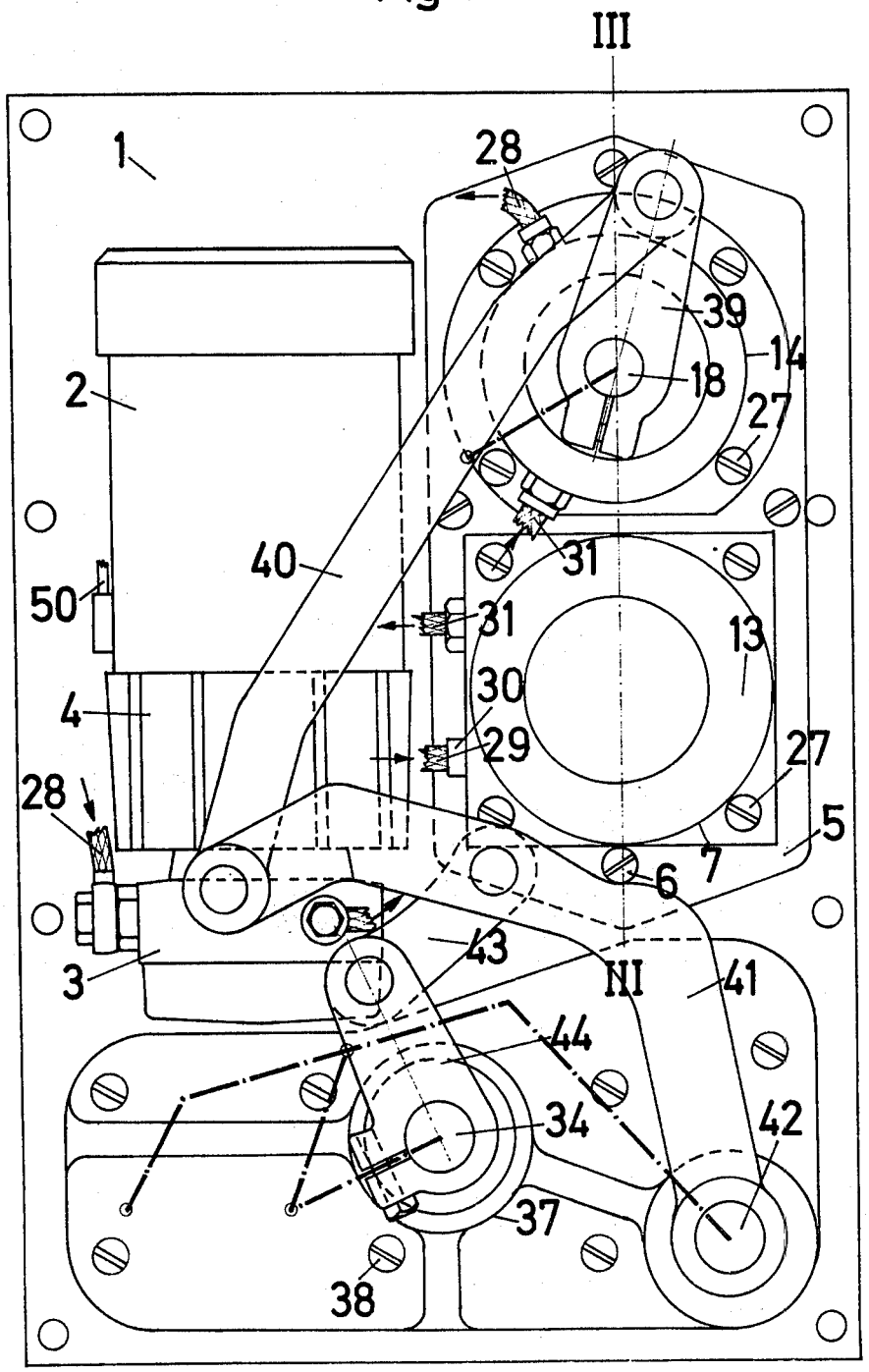
FIG. 1 is a view from below of a swing door opener according to the invention intended for mounting in the floor below a door hinge.
Figure 2:
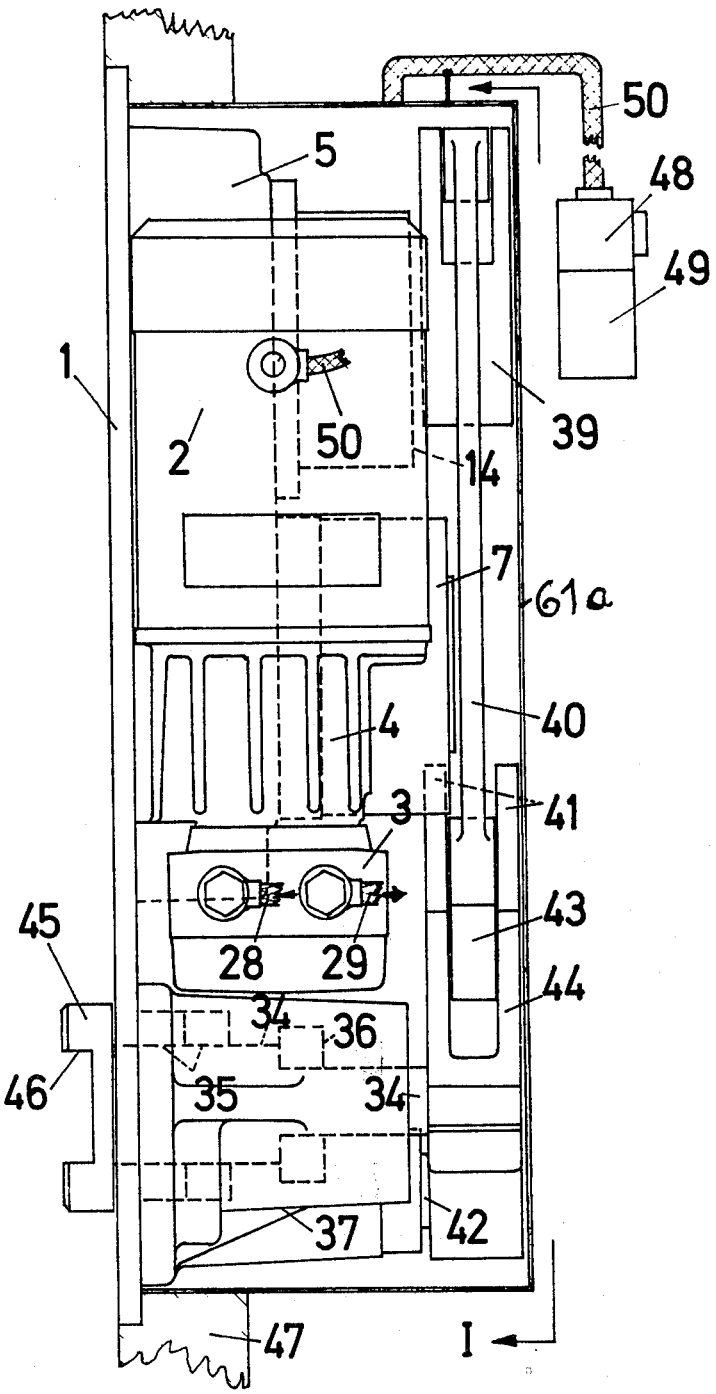
FIG. 2 is a side view (turned through 90°) of the door opener in FIG. 1 with a cover and part of the floor in section.
Figure 3:
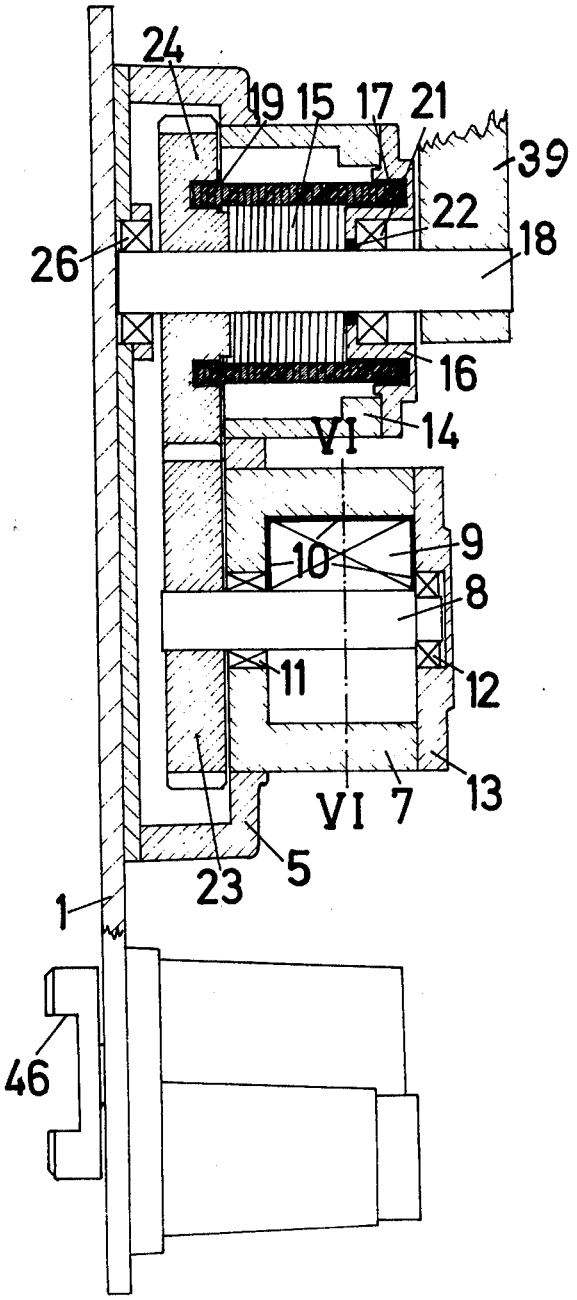
FIG. 3 is a partial section of the door opener of FIG. 1 along lines III—III in FIG. 1.

The hydraulic door opener illustrated in FIGS. 1–3 provides simple and space saving means for operating a swing door by a unit disposed in the floor below the hinge portion of the door in an easily acessible position and provided with means for carrying or engaging the lower part of the door frame.

This opener consists of a frame 1, which is adapted to be fitted in the floor structure below the hinge side of a swing door, and carries a motor driven hydraulic pump 2, 3, which in the illustrated embodiment consists of an electric motor 2 which through a bearing and coupling housing 4 is coupled to a hydraulic liquid pump 3 of a conventional gear type. The frame 1, furthermore, carries a transmission casing 5 secured to the frame by bolts 6 and carrying a hydraulically operated rotary motor comprising a working cylinder 7, a motor shaft 8 and a vane type piston 9 secured to the shaft. Suitable high grade resinous sealing ribs 10 are provided along the piston edges to produce perfect seals. The motor is capable of turning through an angle of some 150°–300° as circumstances may require. The motor shaft 8 is mounted in bearings 11,12 in the transmission casing and the working cylinder end cover 13 and its axis is perpendicular to that of the electric motor 2.

The transmission casing 5 carries a door closing spring housing 14 which contains a torsional helical spring 15 which consists of a number of turns of flat spring steel mounted with the flat sides in juxtaposition to provide a very stiff spring and connected with one end to an end cover 16 of the spring housing 14 as at 17 and at the opposite end to a spring or auxiliary shaft 18 as at 19. The spring shaft is mounted in bearings 26,21 in the transmission casing 5 and spring housing cover 16 and ample seals 22 prevent escape of hydraulic liquid from the spring housing which serves as a hydraulic liquid reservoir for the hydraulic circuit of the door opener. 14 and 5 communicate to form the reservoir.

The transmission casing 5 contains two toothed gear wheels 23,24 secured on the shafts 8 and 18 and providing a suitable power transmitting ratio between these shafts which are mounted in bearings in the transmission casing 5 and covers 13,16. Naturally the wheels 23,24 may be replaced by sprockets and an endless chain cooperating therewith. The working cylinder 7 and spring housing 14 are secured to the transmission casing by bolts 27.

The suction side of the pump 3 communicates with the hydraulic liquid reservoir in the spring housing 14 through a hose 28 and the pressure side of the pump 3 communicates with one side 26' of the motor piston 9 through a hose 29 through a check valve 30 which prevents backflow towards the pump when it is idle. The hydraulic motor 7 communicates with the reservoir in the spring housing 14 through a hose 31. During a door opening operation the piston 9 swings from its position in FIG. 6 through an angle depending on the design of the opener.

Figure 6:
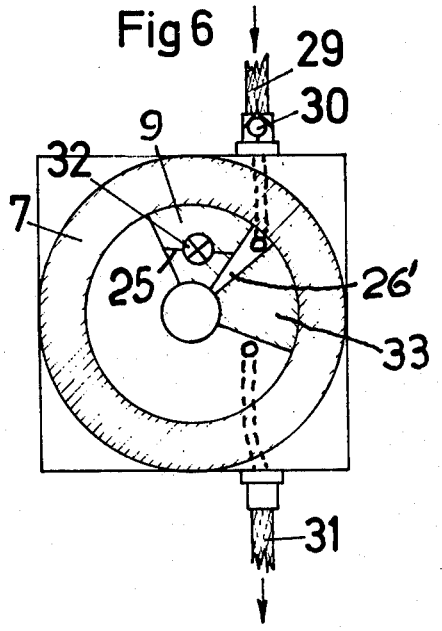
FIG. 6 is a section on lines VI—VI in FIGS. 3 and 5.

During door closing operation the spring 15 swings the piston 9 back into FIG. 6 position. In order to enable the piston to return to its closed door position after having made an opening stroke a special check valve 32 may be provided in the piston 9 or in a radial wall 33 in the turning motor cylinder 7. The valve 32 permits hydraulic liquid to pass from the pressure side 26' of the piston to the relieved side when the spring 15 swings the piston back to closed door position. Valve 32 may consist of a spool valve closing the passage 25 against spring pressure when the pump runs and opening the passage when it comes to rest.

The motion of the motor piston 9 and shaft 8 is transmitted to a door carrying or engaging main shaft 34 which is carried in radial and thrust bearings 35,36 in a bearing housing 37 secured to the underside of the frame 1 by bolts 38. The motion transmission from the turning motor shaft 8 is carried over the gear wheels 23,24 to the spring shaft 18 and a lever system comprising an arm 39 fixed to the spring shaft and pivotally connected to a link 40, which is pivotally connected to a bent arm 41 swingable on a pivot 42 on the bearing housing 37. A link 43 pivotally connects the arm 41 to a main shaft arm 44 secured to the lower end of the main shaft 34. (Alternatively the lever system may be connected to the motor shaft 8) The upper end of the main shaft 34 is formed with a door engaging socket 45 which has a transverse groove 46 in which the door wing may be secured or otherwise fitted. The illustrated lever system produces a turning motion of 90°–95° of the main shaft 34 upon a turning motion through about 160° of the spring or auxiliary shaft 18 and a corresponding or larger turning motion of the motor shaft 8. The spring 15, which may have some pre-tension (for instance equivalent to turning the shaft 8 or the shaft 18 through about 15°), is further tensioned by the opening motion of the door and afterwards produces the closing motion of the door. The floor structure in which the opener is fitted is indicated at 47 and a protective cover at 61 a.

The operation of the door opener is controlled by an actuator 48 which may be an electric switch operated by a push button or an other device and which after being pressed in remains closed for a predetermined time period which is controlled by a time delay relay 49 both provided in the electric line 50 to the pump motor. When the push button of the switch 48 has been pressed, the motor 2 starts and drives the pump for the period set by the time delay relay which is sufficient for fully opening the door. When the motor has stopped, the spring 15 returns the door to closed position if desired after further time delay. Means for reducing the turning speed at both ends of the door swinging stroke may be provided in well-known ways. The opener does not prevent manual operation of the door.

Figure 4:
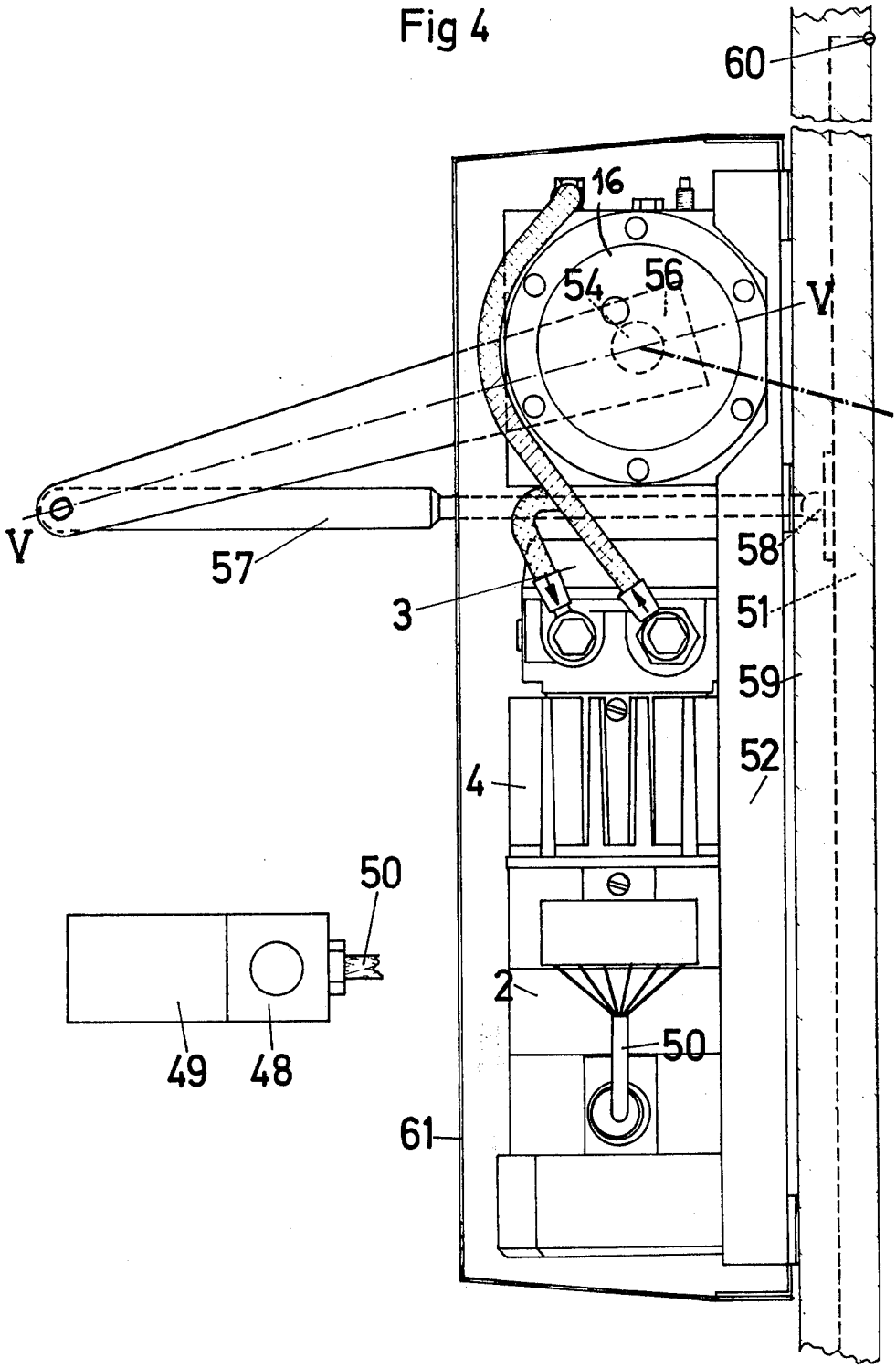
FIG. 4 is a view from above embodiment of a door opener according to the invention intended for being fitted on the wall above a swing door.
Figure 5:
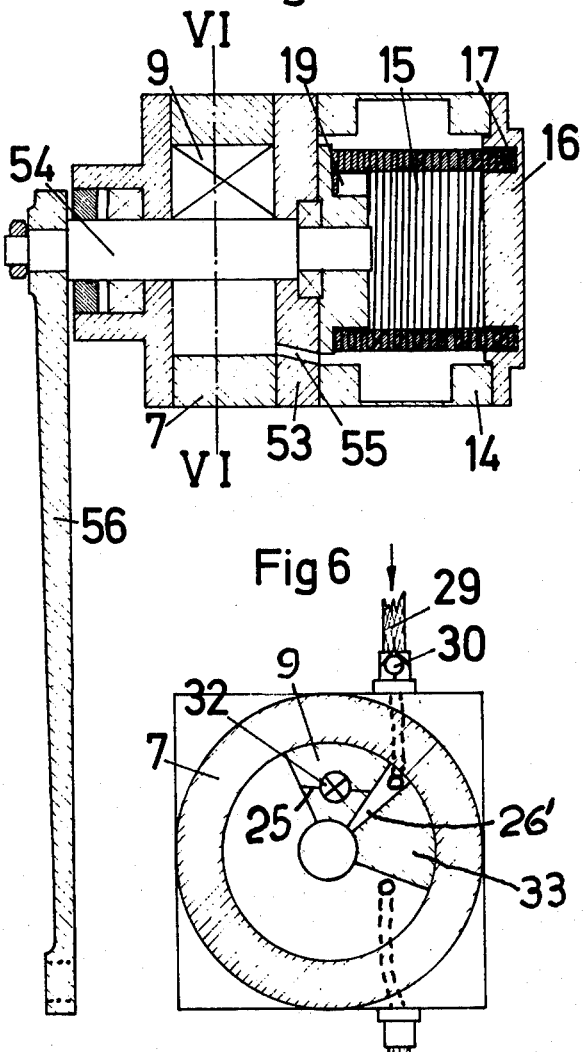
FIG. 5 is a section on lines V—V in FIG. 4.

In the embodiment illustrated on FIGS. 4–6 equivalent elements to those above described are indicated with the same reference numerals and not described again. This embodiment is intended for mounting above a door wing 51 of a swing door but may also be mounted on the door or divided in two parts, one being on the door and the other on the frame. It provides simple and space saving opening and closing means having easily accessible and serviceable elements.

The illustrated opener consists of a base plate 52 fixed to the wall 59 in any suitable way, as by screws, and carrying a motor driven hydraulic pump 2,3, a rotary motor cylinder 7 and a spring housing 14. In this case, however, the cylinder 7 and housing 14 are mounted coaxially on each side of an intermediate wall 53 and provided with a common shaft 54, which extends through the motor cylinder 7 and carries the vane type piston 9 and through the spring housing 14 in which the spring 15 is secured to the shaft as at 19. This gives a very compact unit in which a direct passage 55 between the cylinder 7 and the reservoir housing 14 replaces hose 31 in FIG. 1. Using the spring housing as liquid reservoir also saves valuable space and makes the whole unit neat.

The shaft 54 has secured thereon an arm 56 which is pivotally connected to a link 57 which in turn is pivotally connected to a bracket 58 fixed to the door wing 51 which may swing on a hinge 60. The motor and spring housing unit together with the motor-pump unit are enclosed by a protective cover 61 fixed on the base plate 52. As mentioned before, the motor-pump unit may be disposed in a separate cover remote from the door, for instance in the ceiling. The door opener in FIGS. 4–6 is operated by a time delay switch 48,49 which may be situated in any convenient place near the door as at the door frame or remote from the door for operation by a watchman or the like. Operation via wireless signals from a small portable transmitter which activates the actuator may also be made, the illustrated actuator being shown as an example only.

The door opener may also be pneumatically operated when electric power is not available or undesirable with regard to fire hazards, and the motor 2 is then replaced by a pneumatic motor and the electric actuator by a pneumatic time delay relay valve.

The embodiments above described should only be considered as examples and may be modified in various ways within the scope of the claims.

The heavy dot and dash lines in FIGS. 1 and 4 show links and arms 39, 41, 43, 44 and 56 in the open door position.

What we claim is:

1. A hydraulic door opener comprising in combination a hydraulically operated rotary motor, a motor shaft mounted in the motor and operatively connected with door engaging means, a hydraulic liquid reservoir, a door operating spring operatively connected with the shaft, a motor-driven hydraulic pump, an actuator for the motor of the motor-driven pump, hydraulic liquid conduits providing communication between the hydraulic pump, the hydraulically operated rotary motor and the hydraulic liquid reservoir and from the reservoir back to the pump so as to produce a closed hydraulic circuit, the rotary motor operating a door to tension the door operating spring, said hydraulic door opener including a spring housing for the door operating spring separately surrounding the spring and providing hydraulic liquid reservoir means as component part of the said hydraulic liquid circuit, said spring housing, said rotary motor and said hydraulic pump being mounted as separate assembly units within said opener to provide easy and separate access thereto.

2. A hydraulic door opener according to claim 1 comprising in combination a frame, a transmission casing in which is mounted the rotary motor shaft and a spring shaft to which the door operating spring is fixed, and power transmitting means operable to transmit power between the spring and the rotary motor shaft, the rotary motor and the spring housing being mounted on the transmission casing which is mounted on the frame together with the door engaging means, the transmission casing and the spring housing together forming the hydraulic liquid reservoir.

3. A hydraulic door opener according to claim 1, in which the spring housing forms a receiver for hydraulic liquid expelled from the rotary motor and is mounted in justaposition to the latter and in which the rotary motor shaft is arranged to engage a door and is operable by the rotary turning motor in one turning direction and by the said spring in the opposite turning direction.

4. A hydraulic door opener according to claim 3, in which the spring housing and a working cylinder for the rotary motor are combined as a unit in which the motor shaft is journalled, the motor shaft being connected to the spring in the spring housing and to a rotary motor vane-type piston hydraulically operated and mounted to turn in the working cylinder.

5. A hydraulic door opener according to claim 1, in which the spring is a torsional spring comprising band type spring steel formed to a helix with the flats of the windings in juxtaposition, one end being operatively connected to the rotary motor shaft and the other end being fixed to the housing enclosing the spring.

6. A hydraulic door opener according to claim 4, in which the unit of the spring housing and the working cylinder is mounted on a base plate and enclosed by a cover, the pump driving motor being a rotary motor directly coupled to the hydraulic pump and mounted on the base plate with its axis perpendicular to the axis of the hydraulic rotary motor shaft.

7. A hydraulic door opener comprising in combination a hydraulically operated rotary motor, a motor shaft mounted in the motor and operatively connected with door engaging means, a hydraulic liquid reservoir, a door operating spring operatively connected with the shaft, a motor-driven hydraulic pump, an actuator for the motor of the motor-driven pump, and hydraulic liquid conduits providing communication between the hydraulically operated rotary motor and the hydraulic liquid reservoir and from the reservoir back to the pump so as to produce a closed hydraulic circuit, the rotary motor operating a door to tension the door operating spring, the hydraulic door opener being characterized by the provision of a spring housing for the door operating spring surrounding the spring and providing hydraulic liquid reservoir means forming part of the said hydraulic liquid circuit, said rotary motor having a working cylinder in which the motor shaft is journalled, said spring housing containing an auxiliary shaft to which the spring is connected, a toothed gear transmission being arranged to transmit turning motion from the motor shaft to said auxiliary shaft, a main shaft supported in bearings and provided with means for carrying a swing door, a lever system for transmitting turning motion of said auxiliary shaft to turn the main shaft through an angle of about 90°, and a base on which the rotary motor, the spring housing, the gear transmission, the main shaft and the lever system are mounted.

8. A hydraulic door opener according to claim 7, in which the auxiliary shaft is arranged to turn about 160° when the main shaft turns about 90°.

9. A hydraulic door opener according to claim 1, in which the spring has a pre-tension equivalent to turning of the motor shaft, the spring shaft or the auxiliary shaft through about 15°.

* * * * *